US005247922A

United States Patent [19]

Lalonde

[11] Patent Number: 5,247,922

[45] Date of Patent: Sep. 28, 1993

[54] BOWSTRING TRIGGER AND SAFETY LOCK APPARATUS

[76] Inventor: Guy Lalonde, 64 Forte de France Ave., Toms River, N.J. 08757

[21] Appl. No.: 918,445

[22] Filed: Jul. 22, 1992

[51] Int. Cl.[5] ..... F41B 5/18

[52] U.S. Cl. ..... 124/35.2; 124/86; 124/90

[58] Field of Search ..... 124/25, 40, 35.2, 86, 124/88, 90

[56] References Cited

U.S. PATENT DOCUMENTS

| | | | |
|---|---|---|---|
| 2,815,016 | 12/1957 | Kellogg . | |
| 2,954,765 | 10/1960 | Carmardella . | |
| 3,665,911 | 5/1972 | Altier | 124/88 X |
| 3,757,763 | 9/1973 | Pinti et al. | 124/35.2 |
| 3,898,974 | 8/1974 | Keck . | |
| 4,232,649 | 11/1980 | Allen et al. | 124/35.2 |
| 4,282,851 | 8/1981 | Lyons | 124/40 X |
| 4,332,233 | 6/1982 | Knoble | 124/35.2 |
| 4,509,497 | 4/1985 | Garvison | 124/35.2 |
| 4,539,968 | 9/1985 | Garvison | 124/35.2 |
| 4,567,875 | 2/1986 | Fletcher | 124/35.2 |
| 4,603,676 | 8/1986 | Luoma | 124/25 |
| 4,612,907 | 9/1986 | Gantt | 124/35.2 |
| 4,969,448 | 11/1990 | Beyer | 124/35.2 |
| 5,009,216 | 4/1991 | Ross | 124/88 |
| 5,065,732 | 11/1991 | Smith | 124/88 |
| 5,067,472 | 11/1991 | Vogel et al. | 124/35.2 |
| 5,156,138 | 10/1992 | Grover | 124/35.2 |

*Primary Examiner*—Randolph A. Reese
*Assistant Examiner*—John Ricci
*Attorney, Agent, or Firm*—Mathews, Woodbridge & Collins

[57] ABSTRACT

A bowstring trigger includes a safety lock to prevent premature release of the arrow. Initially, the trigger is cocked by pushing the arrow onto the bowstring thereby causing a bowstring gripper lever to engage the bowstring. In this state, a safety lock lever under the influence of a bias spring moves into the normal path of the trigger lever thereby preventing it from releasing the release lever. A safety release guide string symmetrically attached to opposite sides of the bow handle is connected to the safety release lever and causes it to move out of engagement with the trigger lever when the bowstring is fully withdrawn. With the safety off, the archer can release the bowstring by pushing on the trigger lever with his or her thumb thereby causing the gripper release lever to disengage the bowstring gripper. The bowstring gripper moves forward under the influence of the bowstring and simultaneously releases the arrow in the direction of the target. A shock absorbing surface on the safety lever prevents damage to the fast moving gripper lever. The invention not only prevents premature release of the arrow, but also improves the accuracy of the archer and helps to prevent injury to the forearm of the bow-holding hand.

10 Claims, 6 Drawing Sheets

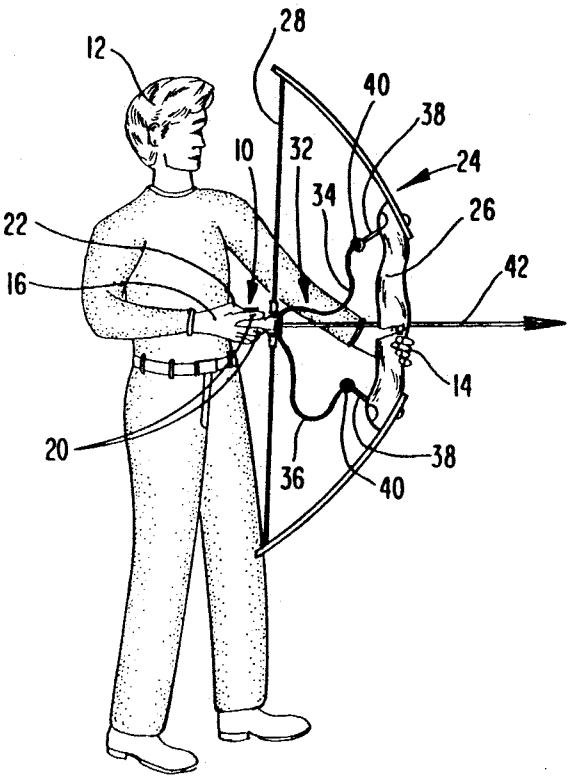
FIG. IC
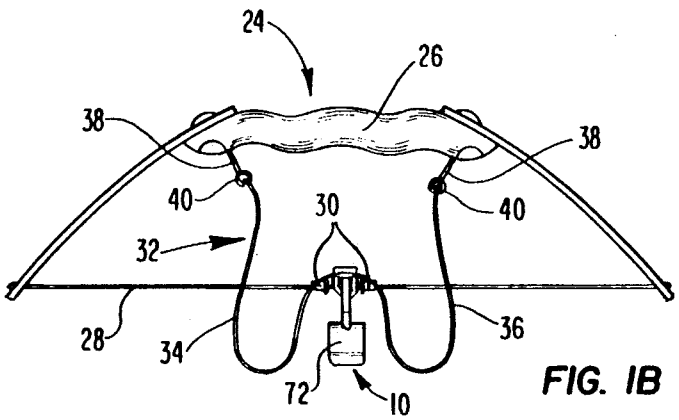
FIG. IB
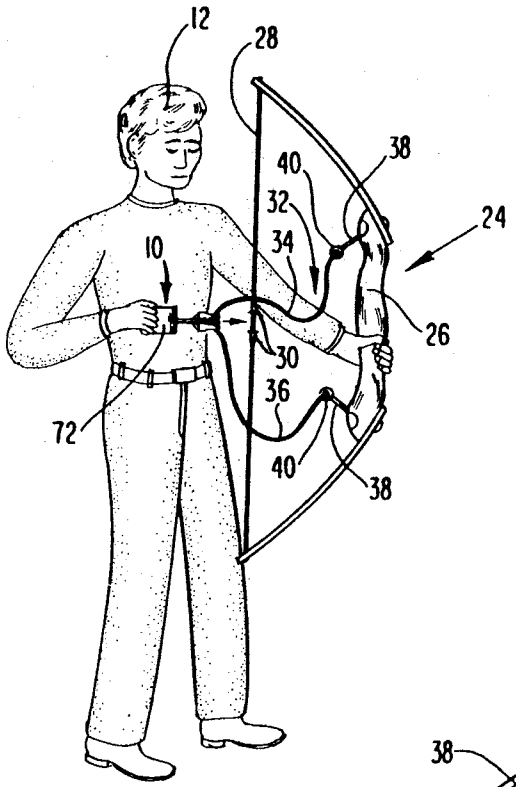
FIG. IA

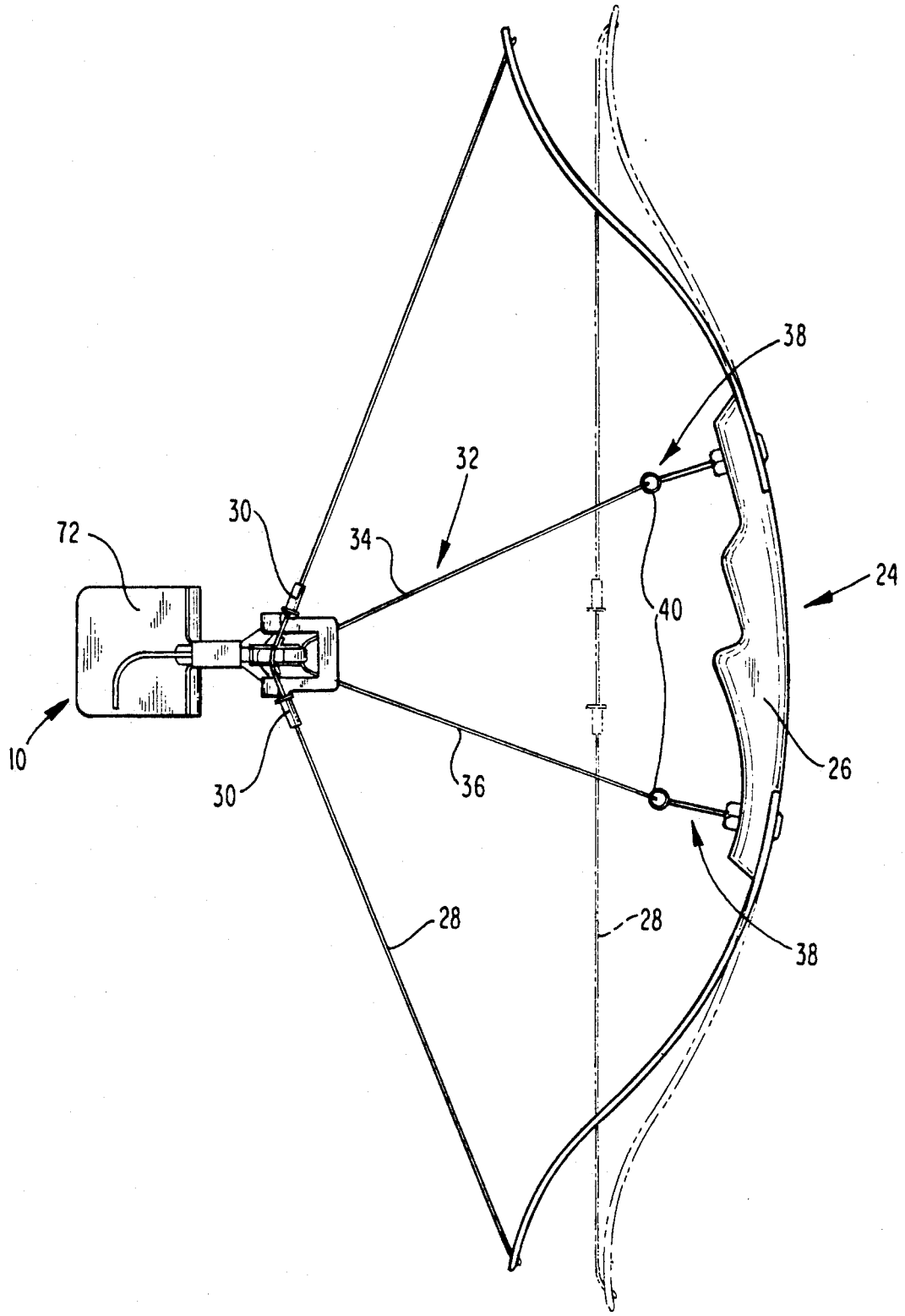
FIG. IF

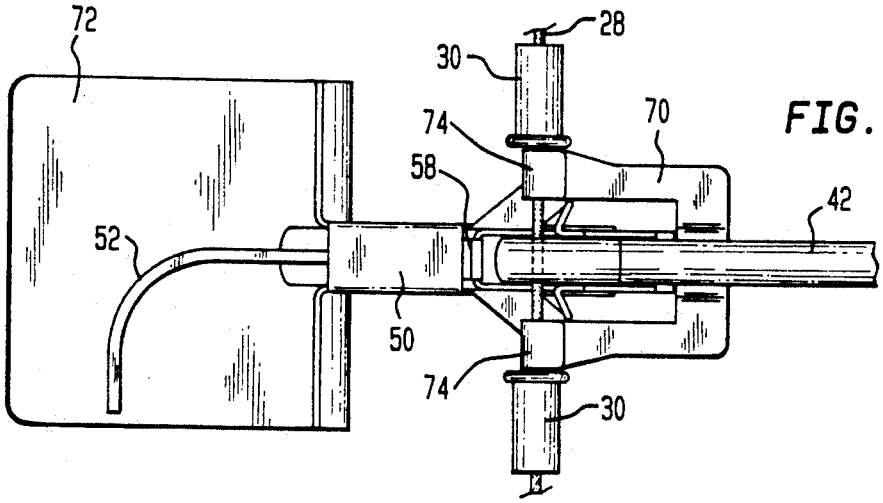
FIG. 2A
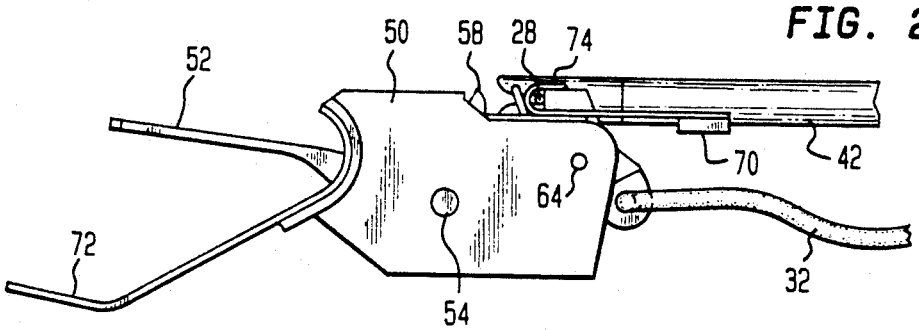
FIG. 2B
FIG. 2C
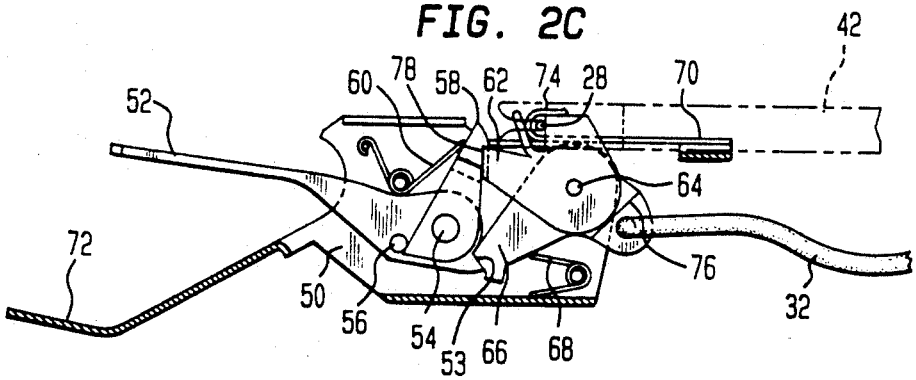
FIG. 2D
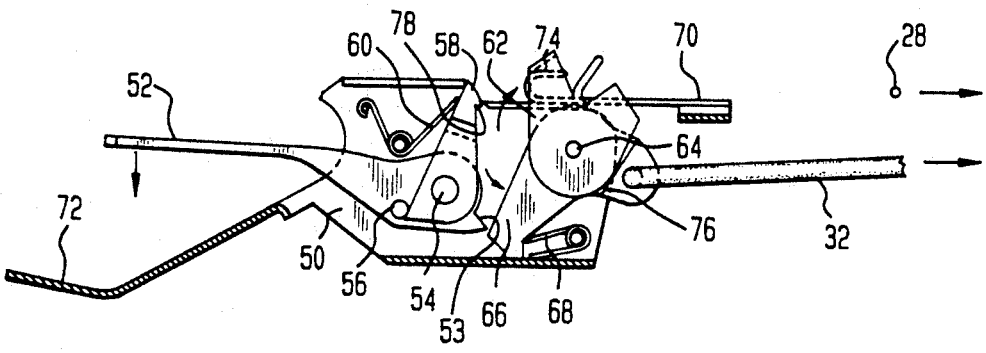

BOWSTRING TRIGGER AND SAFETY LOCK APPARATUS

BACKGROUND OF THE INVENTION

1. Field of the Invention

This invention relates to an archery bowstring trigger with a safety lock to prevent premature, accidental release of the bowstring.

2. Description of Related Art

Devices for releasing bowstrings are known in the art. For example, U.S. Pat. No. 4,539,968 describes a bowstring release device that includes a rotary, latchable member that can be released by a trigger. Horizontal movement of a vertical trigger releases the rotary latch under the influence of the tension of the bowstring.

U.S. Pat. No. 3,898,974 describes a horizontal release mechanism. The horizontal movement of the user's thumb against the trigger portion of the operating arm swings a catch out of engagement with the arm mechanism of the spring-biased bowstring holding member. Another horizontal release mechanism is described in U.S Pat. No. 4,567,875.

Other release mechanisms are described in U.S. Pat. Nos. 4,509,497; 4,969,448; 4,232,649; 3,757,763; 4,612,907 and 4,332,233.

Some of the prior art patents also describe devices for limiting the length of the draw of a bowstring. For example, the purpose of the invention described in U.S. Pat. No. 3,665,911 is to maintain a constant draw length during shooting. Other similar patents include U.S. Pat. No. 5,065,732; U.S. Pat. No. 2,954,765 and U.S. Pat. No. 2,815,016.

While bowstring release devices can be found in the prior art, the use of safety locking mechanisms in this context is generally not known.

SUMMARY OF THE INVENTION

Briefly described, the invention comprises a bowstring trigger which includes a safety lock lever to prevent premature release of the arrow. The bowstring trigger includes four primary moving parts including the bowstring trigger lever, a gripper release lever, a bowstring gripper and a safety lock lever. The device is cocked by moving the trigger in the direction of bowstring. A bowstring guide surface, which forms an extension of the housing of the trigger, guides the bowstring into a cradle. At the same time, the bowstring contacts the gripper mechanism and rotates it counterclockwise until the gripper mechanism engages a notch in the trigger release lever. The trigger lever is immobilized by a safety lock lever which likewise engages a notch in the trigger lever. The trigger lever cannot be released until the safety lock is disengaged. An arrow can be held in that position indefinitely with the split in its nock around the bowstring until such time as the archer is ready to use it. A small notch, preferably in the side of the nock, helps to keep the arrow from falling out of the trigger.

When the archer draws back on the bowstring to the full extent possible, a safety release guide string, attached symmetrically to the upper and lower body portions of the bow, exerts a force on the safety lock lever causing it to rotate out of engagement with the notch in the gripper release lever. This disengages the safety from the trigger. Thumb pressure on the trigger lever will then rotate the gripper release lever out of engagement with the bowstring gripper thereby releasing the bowstring and propelling the arrow in the direction of its target.

These and other features will be more fully understood by reference to the following drawings.

BRIEF DESCRIPTION OF THE DRAWINGS

FIG. 1A illustrates the manner in which an archer attaches the preferred embodiment of the bowstring trigger to the bowstring of a conventional bow.

FIG. 1B illustrates the manner in which the bowstring trigger locks onto a bowstring even when it is not in use.

FIG. 1C illustrates the manner by which an archer begins to draw back on the bowstring with the trigger during which time the safety lock is engaged or "on" thereby preventing premature release of the arrow.

FIG. 1F illustrates the fully withdrawn bow such as seen in FIG. 1D superimposed over a non-withdrawn bow such as seen, for example, in FIG. 1B to show the relative motion of respective parts of the invention.

FIG. 2A is a side elevational view of the preferred embodiment of the bowstring trigger invention.

FIG. 2B is a top plan view of the bowstring trigger illustrated in FIG. 2A.

FIG. 2C is a top, cross-sectional view of the bowstring trigger illustrated in FIG. 2B with the safety lock feature engaged thereby preventing premature or accidental release of the trigger lever.

FIG. 2D is a top, cross-sectional view of the bowstring trigger illustrated in FIG. 2B with the safety lock disengaged thereby permitting actuation of the trigger lever to launch the arrow in the direction of its target.

DETAILED DESCRIPTION OF THE PREFERRED EMBODIMENT

During the course of this description like numbers will be used to identify like elements according to the different figures that illustrate the invention.

Figure 1E:
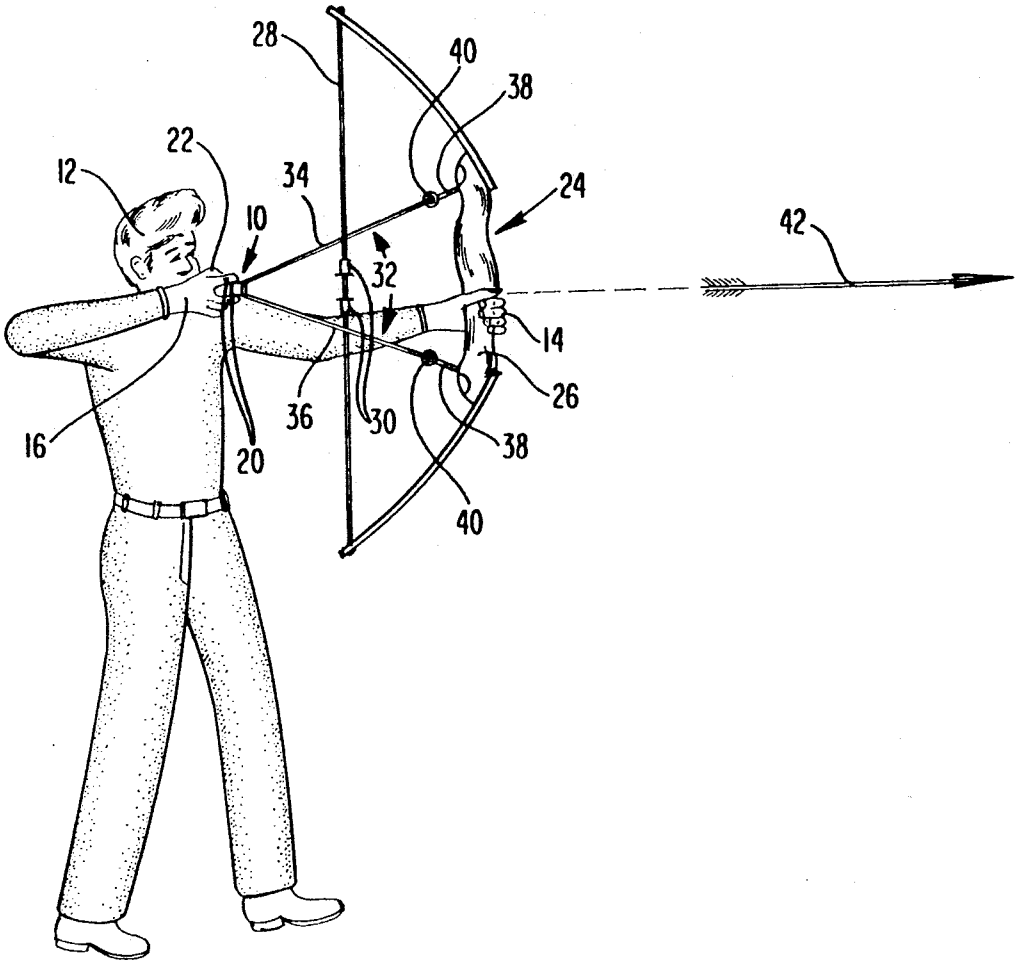
FIG. 1E illustrates the invention after the archer has released the trigger lever thereby sending the arrow in the direction of its target.

The bowstring trigger and the safety lock invention 10 according to the preferred embodiment is illustrated in the context of its environment in FIGS. 1A–1E. Initially the archer 12 moves the trigger 10 in the direction of bowstring 28 as shown in FIG. 1A. A pair of bowstring markers 30 located on bowstring 28 help the archer 12 to center the bowstring trigger 10 on the portion of the bowstring 28 directly across from the bow handle 26. Bowstring guide 70, which is also an extension of housing 50, guides the bowstring 28 into bowstring cradle 74. At the same time bowstring gripper 62, FIG. 2C, rotates behind the bowstring 28 and locks into position. This is described in more detail with reference to FIGS. 2A-2D.

Figure 4:
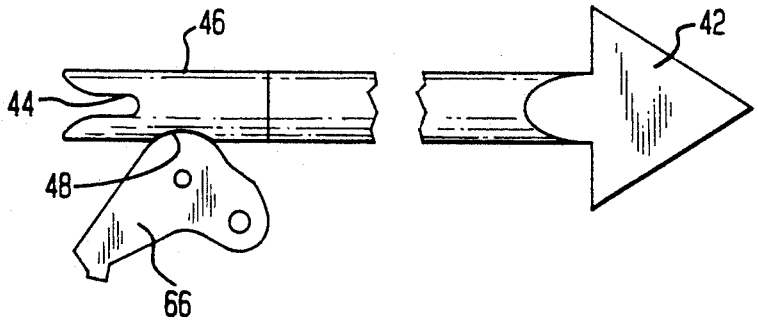
FIG. 4 is a detailed, partially broken away view of the nock of the arrow including a notch for holding the arrow in engagement with the bowstring trigger when not in use so that the arrow does not fall out of the trigger.

Once the bowstring trigger 10 is locked onto bowstring 28 it is possible to carry it around as shown in FIG. 1B in either the horizontal or vertical position until it is ready for use. It is also possible to pre-load an arrow 42 onto the bowstring 28 and keep it there until it is needed. As shown in FIG. 4, the arrow 42 includes a nock 46, a conventional "V" shaped string engaging groove 44 and notch 48. Notch 48 loosely engages a protrusion on the trigger 10 which holds arrow 42 there even if bow 24 is inverted. The holding force of the notch 48 is, however, so small that when the bowstring 28 is drawn back and released the forward momentum of the arrow 42 will easily overcome the holding force of the notch 48.

In FIG. 1C an archer 12 is shown holding a bow 24 with his left hand 14. Left hand 14 is wrapped around the bow handle grip 26 in the conventional manner. The archer's other hand 16 is shown holding the bowstring trigger 10. The index and middle fingers 20 of the trigger holding hand 16 wrap around the trigger guard 72 which is an extension of the housing 50. The thumb 22 of the trigger holding hand 16 is located adjacent trigger lever 52 and opposes index and middle fingers 20.

FIG. 1C illustrates the archer 12 in the process of drawing the bowstring 28 back while aiming at a target. In this position it is impossible for the archer 12 to release the trigger lever 52 because the safety lock 66 interferes with its movement. Safety lock lever 66 is attached by safety release guide string 32 to a pair of standoffs 38 located symmetrically on opposite sides of bow handle 26. The top portion 34 of safety release guide string 32 is attached to the eyelet 40 in the top standoff 38. Similarly, the bottom portion 36 of the safety release guide string 32 is attached to the eyelet 40 of the bottom standoff 38. Each of the standoffs 38 preferably comprise rigid rods having a length of approximately four to six inches between eyelets 40 and the point at which the standoff 38 makes contact with the body of the bow 24. The index and middle fingers 20 of the archer's trigger hand 16 wrap around the trigger guard 72 of housing 50 and serve as a grip for the purpose of drawing back on bowstring 28. Archer 12 otherwise performs the aiming and bowstring drawing function in the same manner as he or she would with a standard, conventional long bow.

Figure 1D:
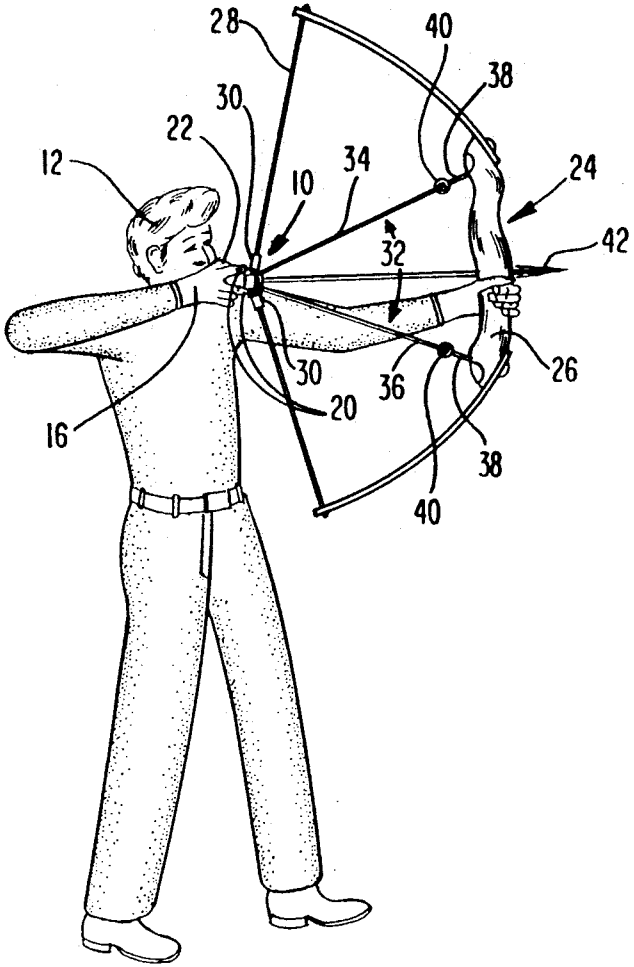
FIG. 1D illustrates the bowstring fully withdrawn at which time the safety release guide strings have released the safety lock on the trigger.

The archer 12 is shown in FIG. 1D with the safety release guide strings 32 in their completely taut, fully extended position. Safety release guide strings 32 have substantially no significant elasticity and, therefore, limit the ability of the archer 12 to draw the bowstring 28 back beyond a specific predetermined point. This has several advantages. First, it means that the force exerted by the bowstring 28 on the arrow 42 is identically repeatable each time since the bowstring 28 is always drawn back by the same distance. This significantly improves the repeatability of the system and, therefore, the archer's accuracy. Second, it significantly stabilizes the bow 24. In a conventional bow, it is possible to overextend the string thereby increasing tension and force on the bow holding hand 14. This can produce both wobble and fatigue. More importantly though, the angle developed between the arm of the bow holding hand 14 and the bowstring 28 pulling hand 16 will cause wobble upon release of the bowstring 28, because there is no diametrically opposed stabilizing forces. This is why the archer 12 tries to reduce this angle by drawing the bowstring 28 back as close to the arm of the bow holding hand 14 as possible. To protect the forearm of the bow holding hand 14 from the path of the bowstring 28 after it is released, requires the archer 12 to wear a forearm guard for protection from the direction of travel of the bowstring 28 if there is any wobble. In contrast, the present invention 10 prevents the archer 12 from overextending the bowstring 28 and provides a diametrically opposed stabilizing force to significantly minimize, if not eliminate, wobble. The safety release guide strings 32, when fully extended, produce a force that is diametrically opposed to the force of the bow holding hand 14, keeping all stabilizing forces within the same plane. The standoffs 38, being four to six inches in length, act to move the central point of the opposing force back beyond the singular point of contact for the bow holding hand 14, triangulating it and thereby significantly increasing its stabilization. This ultimately increases accuracy and prevents the forearm of the bow holding hand 14 from being in the path of the released bowstring 12 thereby protecting it from abrasion and injury. Third, the safety release guide strings 32 as shown in the fully withdrawn mode of FIG. 1D exert a force on the safety lock 66 so as to permit the thumb 22 of the archer 12 to push the trigger lever 52 in the direction of trigger guard 72 thereby releasing the bowstring gripper 62 and propelling arrow 42 towards its target.

FIG. 1E illustrates the invention 10 immediately after the arrow 42 has been released. Note that the trigger 10 remains in the trigger hand 16 of the archer 12. In order to shoot another arrow 42, the archer 12 merely repeats the steps described with regard to FIGS. 1A-1E above. FIG. 1F summarizes the movement of the respective parts of the preferred embodiment 10 by superimposing a fully withdrawn bow 24, such as shown in FIG. 1D over a fully non-withdrawn bow 24, such as shown in FIG. 1B.

Details of the trigger 10 may be more fully understood by referring to FIGS. 2A-2D. FIG. 2A is a side view of the trigger 10 shown with the device engaged and locked on bowstring 28. FIG. 2B is a top plan view of the same trigger 10 illustrated in FIG. 2A.

FIG. 2C is a cross-sectional view of the trigger 10 seen in FIG. 2B with the top portion of the housing removed to reveal the four major moving parts of the invention. The four major moving parts of the invention comprise trigger lever 52, gripper release lever 58, bowstring gripper lever 62 and safety lock lever 66. A pivot pin 54 attached to housing 50 is common to trigger lever 52 and gripper release lever 58. Post 56 mounted on trigger lever 52 exerts a force on gripper release lever 58 but permits it to rotate against the force of a wire bias spring 60 when the trigger 10 is cocked. Similarly, bowstring gripper 62 and safety lock lever 66 share a common pivot pin 64 also mounted on housing 50. A wire spring 68 biases lever 66 in the direction of safety engagement with trigger lever 52 unless otherwise pulled out of engagement by safety release guide string 32 as shown in FIG. 2D. Safety lock lever 66 includes a shock absorbing surface 76 which accepts the impact of the released bowstring gripper 62.

The cross-sectional view of FIG. 2C illustrates the state of the trigger 10 and its moving parts when the bow 24 is in its partially withdrawn mode as illustrated in FIG. 1A-1D.

FIG. 2D illustrates the bow trigger invention 10 immediately after release of the trigger lever 52 and the bowstring 68 as would be the state in FIG. 1E.

When the trigger 10 is initially cocked as shown in FIGS. 1B and 1C, it is moved in the direction of bowstring 28 as shown in FIG. 1A so that guide 70 brings it into bowstring cradle 74. Bowstring cradle 74 comprises a pair of fingers on opposite sides of bowstring 28 with a gap in between sufficient to permit the "V" groove 44 in the nock 46 of arrow 42 to completely engage the bowstring 28 in the normal fashion. As previously described, the notch 48 engages a portion of the trigger 10 and keeps the arrow 42 from falling out during transportation. The movement of bowstring 28 into bowstring cradle 74 impinges upon a portion of bowstring gripper 62 causing it to rotate counterclockwise. As bowstring gripper 62 rotates counterclockwise it moves against the surface of the gripper release lever 58 until it falls into notch 78. Gripper lever 62 can rotate counterclockwise against gripper release lever 58 because lever 58 can move slightly counterclockwise itself, limited only by post 56 on trigger lever 52, bias spring 60 and the upper part of housing 50. In the cocked mode of FIG. 2C, the trigger lever 52 is immobilized by the safety lock lever 66 which rests in notch 53 on trigger lever 52 and biased in that position by spring 68. Therefore, in the cocked position it is impossible to release the bowstring 28 without first releasing the safety lock lever 66.

When the bowstring 28 is fully drawn back, as shown in FIGS. 1D and 2D, the safety release guide string 32 exerts a force on the safety lever 66 in the direction of the bow 24 causing the safety lever 66 to rotate in the counterclockwise direction. This causes the lever 66 to slip out of the notch 53 in the trigger lever 52 thereby effectively disengaging the safety mechanism. In this state, the archer 12 can fire the bow 24 by pushing on the trigger lever 52 with his or her thumb 22 in the direction of trigger guard 72. This action causes post 56 mounted on trigger lever 52 to impinge upon gripper release lever 58 and move it in a counterclockwise direction. After a predetermined amount of counterclockwise rotation by gripper release lever 58, the bowstring gripper lever 62 drops out of engagement with the notch 78 on the gripper release lever 58. Once the bowstring gripper lever 62 has been released, it will rotate in the clockwise direction under the influence of the bowstring 28. At the same time, the bowstring 28 moves out of the bowstring cradle 74 and in the direction of the bow 24, taking the arrow 42 with it in the conventional manner. Because the force of the released bowstring 28 is significant, the bowstring gripper lever 62 rotates in a clockwise direction with a great deal of energy. This energy is absorbed in part by the relatively flat shock absorbing "L" shaped surface 76 of the safety lock lever 66, and in part by the elasticity of the guide string 32. This feature helps to reduce the wear and tear on the trigger 10 and significantly extend its life.

After the bowstring 28 is released and the archer 12 removes his or her thumb pressure from the lever 52, the pressure exerted by bias spring 60 urges the trigger lever 52 to rotate back to a full clockwise position. Simultaneously, safety lock bias spring 68 drives the safety lock lever 66 in a clockwise direction so as to re-engage the safety notch 53 on the trigger lever 52.

Figure 3:
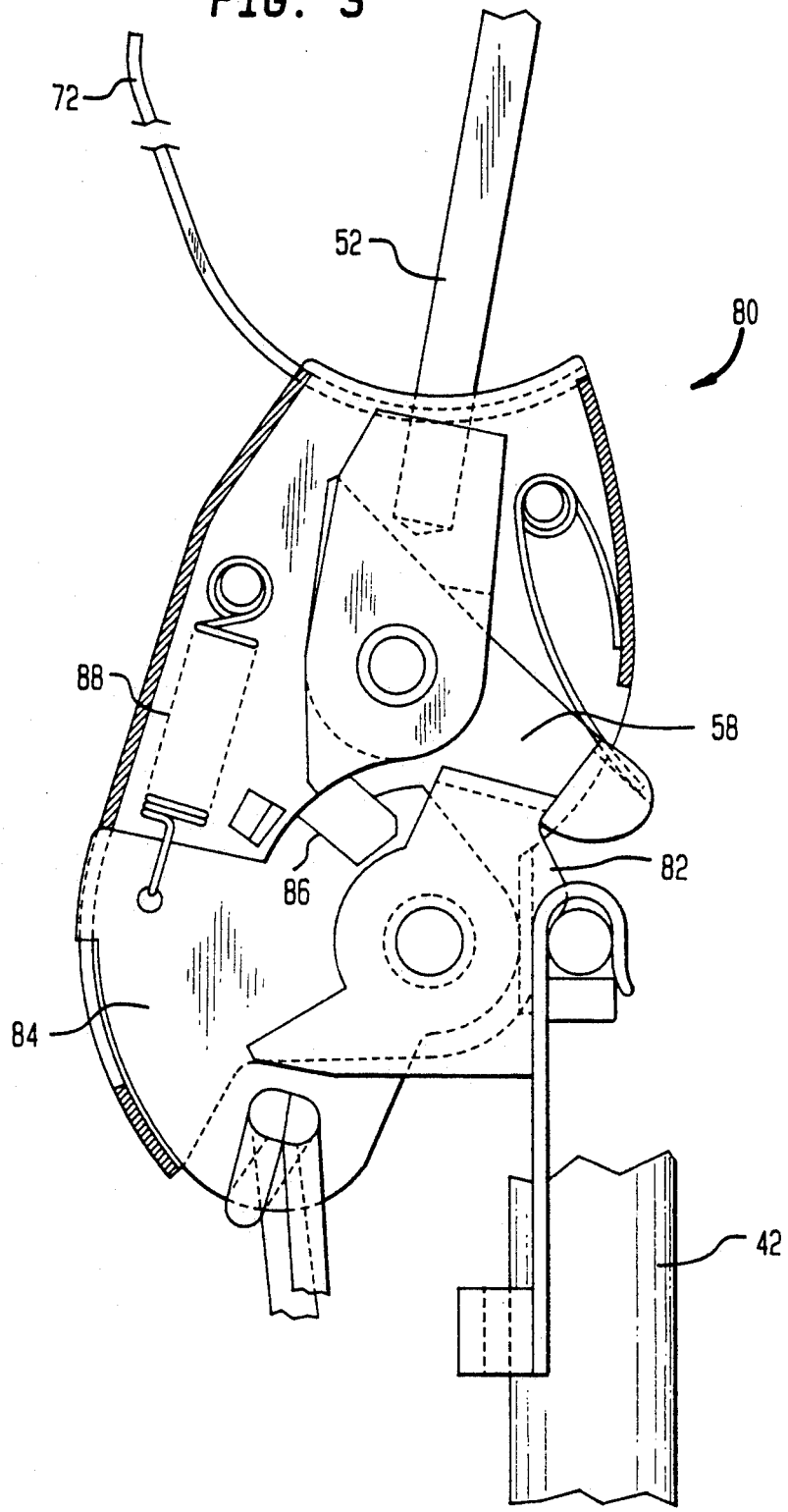
FIG. 3 is a top, cross-sectional view of an alternative embodiment of the bowstring trigger invention.

FIG. 3 is a top plan cross-sectional view of an alternative embodiment 80 of the present invention. The basic concepts of the invention remain the same but are achieved by a different structure. The bowstring gripper lever 82 shares a common pivot post with the safety lock lever 84. Safety lock lever 84 is biased in a full clockwise position by coil spring 88. A protrusion 86 forms a stop for the travel of gripper release lever 58. Alternative embodiment 80 is illustrated in the cocked and safety locked state in FIG. 3. If the bowstring 28 is withdrawn, the safety release guide string 32 will exert a force on the safety lock lever 84 causing it to rotate in the counterclockwise direction against the influence of coiled bias spring 88. Simultaneously the stop 86 mounted on safety lock 84 will rotate out of engagement with the gripper lever 82 thereby removing the safety protection. The thumb 22 of the archer 12 then exerts pressure on the trigger lever 52 in the direction of trigger guard 72 thereby causing the gripper release lever 58 to disengage the bowstring gripper 82. Bowstring gripper 82 then rotates in the clockwise direction releasing bowstring 28 from the cradle 74 while, simultaneously, the bowstring 28 propels arrow 42 in the direction of its target.

Figure 5:
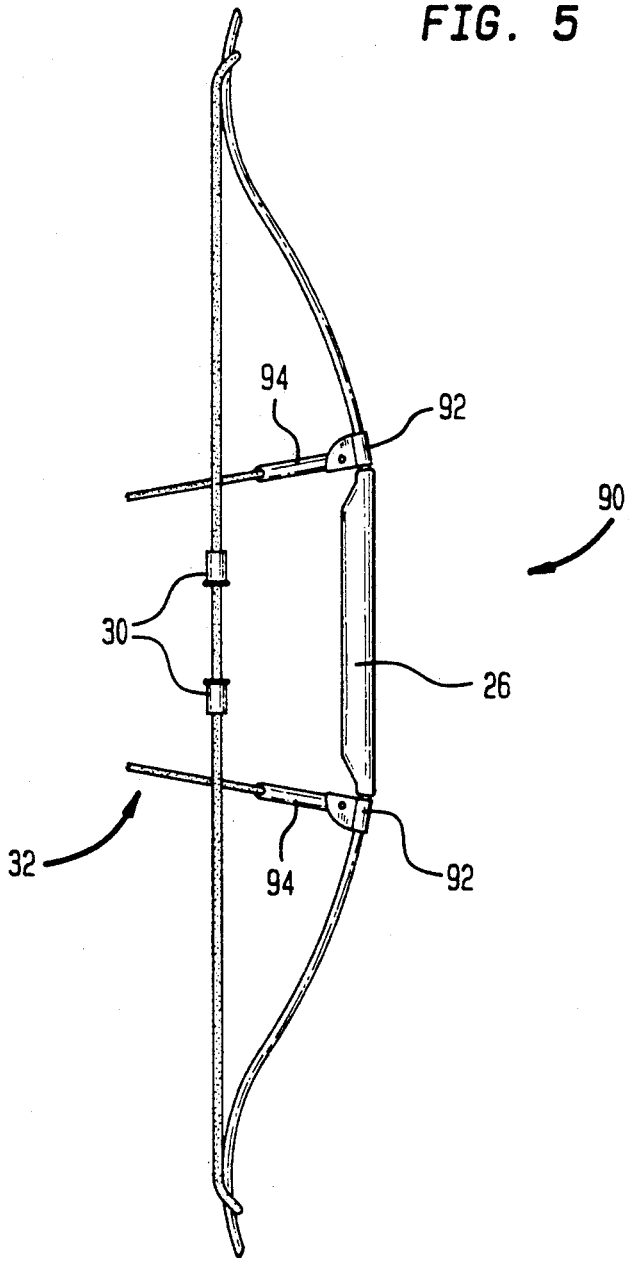
FIG. 5 illustrates an alternative embodiment of the invention, employing slip-on mountings for the safety release guide string locatable on opposite sides of the bow handle.

According to the preferred embodiment of the invention 10, the safety release guide string 28 is attached to the body of the bow 24 by a pair of rigid standoffs 38. Rigid standoffs 38 are preferably mounted on the bow 24 by drilling a hole directly through the body and making the attachment secure by a pair of nuts located on opposite sides of the threaded standoffs 38. That is the preferred method of mounting the standoffs 3 in view of the fact that the attachments are rigid. However, if it is desired to connect the safety release guide string 32 to the bow 24 without drilling through the bow 24, it is possible to do it according to the alternative embodiment 90 shown in FIG. 5. According to the alternative embodiment 90 a pair of slip-on brackets 92 having a relatively square cross-section mimicking the cross-section of the bow 24 can be attached to the bow 24 by slipping them over opposite ends. They naturally come to rest at the locations that are approximately equidistant from the bow handle 26. An eyelet 94 serves as a point of attachment for the upper and lower portions 34 and 36 of the safety release guide string 32. The invention 10 may then be used in the manner previously described with reference to FIGS. 1A–4.

The invention thus described with regard to its preferred embodiment has several advantages over prior art inventions. First, the safety release feature prevents the arrow 42 from being fired prematurely. This clearly adds t the safety of the archer 12 and anyone nearby. Second, the safety release guide string 32 guarantees that the bowstring 28 will be drawn back to exactly the same location each time and provides a diametrically opposed force along the same plane. This improves the reliability and accuracy of the archer 12. Third, by locating the safety release guide strings 32 symmetrically on opposite sides of the bow handle 26 and extended back via the standoffs 38, the force is triangulated and evenly distributed. Fourth, by having the forces diametrically opposed and along the same plane (instead of on an angle as in a conventional bow), the forearm of the archer 12 is never in the path of the released bowstring 26. This prevents injury to the forearm of the archer 12 and eliminates the need for a conventional forearm guard.

While the invention has been described with reference to the preferred embodiment thereof, it will be appreciated by those of ordinary skill in the art that modifications can be made to the structure and function of the invention without departing from the spirit and scope thereof.

I claim:

1. A bowstring releasing apparatus for use by an archer with a bow having a bow frame, a bow frame handle grip and a bowstring attached to said bow frame, said apparatus comprising:

a trigger means for engaging said bowstring; and, a safety means for selectively engaging said trigger means and for selectively preventing said trigger means from accidentally releasing said bowstring, said safety means including a safety lever means for relative movement between a first position where it engages said trigger means and a second position where it is disengaged from said trigger means, and a cord means attached to said bow frame and to said safety lever means for moving said safety lever means from said first position to said second position after said bowstring has been drawn a predetermined distance away from said bow frame, wherein when said bowstring is substantially fully drawn back, said safety lever means disengages said trigger means, thereby enabling said trigger means to permit release of said bowstring.

2. The apparatus of claim 1 wherein said cord means further comprises:

two bow frame mounting means attached to said bow frame; and, a cord attached to said two bow frame mounting means and to said safety lever means.

3. The apparatus of claim 2 wherein said two bow frame mounting means comprise rigid standoff members mounted on opposite sides of said bow frame handle grip.

4. The apparatus of claim 3 wherein said trigger means includes a guard for engaging at least the index and middle finger of one hand of said archer.

5. The apparatus of claim 4 further comprising:

a trigger lever means for actuation by a digit of said archer;

a gripper release lever means for selective release by said trigger lever means; and, a bowstring gripper means for gripping said bowstring, wherein said safety lever means restrains said bowstring gripper means when said safety lever means is in said first position and wherein actuation of said trigger lever means releases said gripper release lever means which in turn releases said bowstring gripper means and said bowstring when said safety lever means is in said second position.

6. The apparatus of claim 5 further comprising:

first spring means for biasing said safety lever means into said first position.

7. The apparatus of claim 6 further comprising:

second spring means for biasing said gripper lever release means into engagement with said bowstring gripper means.

8. The apparatus of claim 2 wherein said bow frame mounting means comprises two temporary members having approximately square openings for mounting on said bow frame on opposite sides of said handle.

9. A bowstring releasing apparatus for use by an archer with a bow having a bow frame, a bow frame handle grip and a bowstring attached to said bow frame, said apparatus comprising:

a trigger lever means for actuation by a digit of said archer;

a gripper release lever means for selective release by said trigger lever means;

a bowstring gripper means for gripping said bowstring and for selective release by said gripper release lever means;

a safety lever means for relative movement between a first position where it engages said trigger lever means and a second position wherein it is disengaged from said trigger lever means; and, a cord means attached to said bow frame and to said safety lever means for moving said safety lever means from said first position to said second position after said bowstring has been drawn a predetermined distance away from said bow frame, wherein said safety lever means restrains said bowstring gripper means when said safety lever means is in said first position and wherein actuation of said trigger lever means releases said gripper release lever means which in turn releases said bowstring gripper means and said bowstring when said safety lever means moves to said second position.

10. A bowstring releasing apparatus for use by an archer with a bow having a bow frame, a bow frame handle grip and a bowstring attached to said bow frame, said apparatus comprising:

a trigger means for engaging said bowstring;

a safety lever means for relative movement between a first position wherein it engages said trigger means and a second position wherein it is disengaged from said trigger means; and, a flexible connecting means attached to said bow frame and to said safety lever means for moving said safety lever means from said first position to said second position after said bowstring has been drawn a predetermined distance away from said bow frame, wherein when said bowstring is drawn back said predetermined distance away from said bow frame, said safety lever means is disengaged from said trigger means, thereby enabling said trigger means to permit release of said bowstring.

* * * * *

UNITED STATES PATENT AND TRADEMARK OFFICE

CERTIFICATE OF CORRECTION

PATENT NO. : 5,247,922

DATED : September 28, 1993

INVENTOR(S) : Guy LaLonde

It is certified that error appears in the above-identified patent and that said Letters Patent is hereby corrected as shown below:

Col. 6, Line 23, please delete "28" and insert instead --32--.

Col. 6, Line 29, please delete "3" and insert instead --38--.

Col. 6, Line 49, please delete "t" and insert instead --to--.

Col. 6, Line 62, please delete "26" and insert instead --28--.

Signed and Sealed this

Seventh Day of June, 1994

Bruce Lehman

*Attest:*

BRUCE LEHMAN

*Attesting Officer*

*Commissioner of Patents and Trademarks*